US006066212A

United States Patent [19]

Koo et al.

[11] Patent Number: 6,066,212

[45] Date of Patent: May 23, 2000

[54] ULTRA-HIGH STRENGTH DUAL PHASE STEELS WITH EXCELLENT CRYOGENIC TEMPERATURE TOUGHNESS

[75] Inventors: Jayoung Koo, Bridgewater; Narasimha-Rao V. Bangaru, Annandale, both of N.J.

[73] Assignee: ExxonMobil Upstream Research Company, Houston, Tex.

[21] Appl. No.: 09/099,152

[22] Filed: Jun. 18, 1998

Related U.S. Application Data

[60] Provisional application No. 60/068,816, Dec. 19, 1997.

[51] Int. Cl.[7] ..... C21D 8/02; C22C 38/08

[52] U.S. Cl. ..... 148/336; 148/654; 148/648

[58] Field of Search ..... 149/336, 654, 149/648, 661, 547

[56] References Cited

U.S. PATENT DOCUMENTS

| | | | |
|---|---|---|---|
| 4,184,898 | 1/1980 | Ouchi et al. | 148/12 |
| 4,687,525 | 8/1987 | Biniasz et al. | 148/336 |
| 5,531,842 | 7/1996 | Koo et al. | 148/654 |
| 5,545,269 | 8/1996 | Koo et al. | 148/654 |
| 5,545,270 | 8/1996 | Koo et al. | 148/654 |
| 5,653,826 | 8/1997 | Koo et al. | 148/328 |
| 5,755,895 | 5/1998 | Tamehiro et al. | 148/336 |
| 5,798,004 | 8/1998 | Tamehiro et al. | 148/336 |
| 5,900,075 | 5/1999 | Koo et al. | 148/328 |

FOREIGN PATENT DOCUMENTS

| | | |
|---|---|---|
| 7-331328 | 12/1995 | Japan . |
| 8-176659 | 7/1996 | Japan . |
| 8-295982 | 11/1996 | Japan . |

OTHER PUBLICATIONS

Reference cited by the Taiwan patent Office in counterpart application, reference title—"Structure Controlling and Toughening of Steel Material", Monthly Journal of Mechanics, vol. 18, No. 3 (1992) pp. 227–235; English language translation of captions of the drawings; English language translation of the paragraph marked with A on p. 228.

*Primary Examiner*—Deborah Yee
*Attorney, Agent, or Firm*—Marcy Lyles

[57] ABSTRACT

An ultra-high strength, weldable, low alloy, dual phase steel with excellent cryogenic temperature toughness in the base plate and in the heat affected zone (HAZ) when welded, having a tensile strength greater than 830 MPa (120 ksi) and a microstructure comprising a ferrite phase and a second phase of predominantly lath martensite and lower bainite, is prepared by heating a steel slab comprising iron and specified weight percentages of some or all of the additives carbon, manganese, nickel, nitrogen, copper, chromium, molybdenum, silicon, niobium, vanadium, titanium, aluminum, and boron; reducing the slab to form plate in one or more passes in a temperature range in which austenite recrystallizes; further reducing the plate in one or more passes in a temperature range below the austenite recrystallization temperature and above the $Ar_3$ transformation temperature; finish rolling the plate between the $Ar_3$ transformation temperature and the $Ar_1$ transformation temperature; quenching the finish rolled plate to a suitable Quench Stop Temperature (QST); and stopping the quenching.

22 Claims, 2 Drawing Sheets

ULTRA-HIGH STRENGTH DUAL PHASE STEELS WITH EXCELLENT CRYOGENIC TEMPERATURE TOUGHNESS

This application claims the benefit of U.S. Provisional Application No. 60/068,816, filed Dec. 19, 1997.

FIELD OF THE INVENTION

This invention relates to ultra-high strength, weldable, low alloy, dual phase steel plates with excellent cryogenic temperature toughness in both the base plate and in the heat affected zone (HAZ) when welded. Furthermore, this invention relates to a method for producing such steel plates.

BACKGROUND OF THE INVENTION

Various terms are defined in the following specification. For convenience, a Glossary of terms is provided herein, immediately preceding the claims.

Frequently, there is a need to store and transport pressurized, volatile fluids at cryogenic temperatures, i.e., at temperatures lower than about −40° C. (−40° F.). For example, there is a need for containers for storing and transporting pressurized liquefied natural gas (PLNG) at a pressure in the broad range of about 1035 kPa (150 psia) to about 7590 kPa (1100 psia) and at a temperature in the range of about −123° C. (−190° F.) to about −62° C. (−80° F.). There is also a need for containers for safely and economically storing and transporting other volatile fluids with high vapor pressure, such as methane, ethane, and propane, at cryogenic temperatures. For such containers to be constructed of a welded steel, the steel must have adequate strength to withstand the fluid pressure and adequate toughness to prevent initiation of a fracture, i.e., a failure event, at the operating conditions, in both the base steel and in the HAZ.

The Ductile to Brittle Transition Temperature (DBTT) delineates the two fracture regimes in structural steels. At temperatures below the DBTT, failure in the steel tends to occur by low energy cleavage (brittle) fracture, while at temperatures above the DBTT, failure in the steel tends to occur by high energy ductile fracture. Welded steels used in the construction of storage and transportation containers for the aforementioned cryogenic temperature applications and for other load-bearing, cryogenic temperature service must have DBTTs well below the service temperature in both the base steel and the HAZ to avoid failure by low energy cleavage fracture.

Nickel-containing steels conventionally used for cryogenic temperature structural applications, e.g., steels with nickel contents of greater than about 3 wt %, have low DBTTs, but also have relatively low tensile strengths. Typically, commercially available 3.5 wt % Ni, 5.5 wt % Ni, and 9 wt % Ni steels have DBTTs of about −100° C. (−150° F.), −155° C. (−250° F.), and −175° C. (−280° F.), respectively, and tensile strengths of up to about 485 MPa (70 ksi), 620 MPa (90 ksi), and 830 MPa (120 ksi), respectively. In order to achieve these combinations of strength and toughness, these steels generally undergo costly processing, e.g., double annealing treatment. In the case of cryogenic temperature applications, industry currently uses these commercial nickel-containing steels because of their good toughness at low temperatures, but must design around their relatively low tensile strengths. The designs generally require excessive steel thicknesses for load-bearing, cryogenic temperature applications. Thus, use of these nickel-containing steels in load-bearing, cryogenic temperature applications tends to be expensive due to the high cost of the steel combined with the steel thicknesses required.

On the other hand, several commercially available, state-of-the-art, low and medium carbon high strength, low alloy (HSLA) steels, for example AISI 4320 or 4330 steels, have the potential to offer superior tensile strengths (e.g., greater than about 830 MPa (120 ksi)) and low cost, but suffer from relatively high DBTTs in general and especially in the weld heat affected zone (HAZ). Generally, with these steels there is a tendency for weldability and low temperature toughness to decrease as tensile strength increases. It is for this reason that currently commercially available, state-of-the-art HSLA steels are not generally considered for cryogenic temperature applications. The high DBTT of the HAZ in these steels is generally due to the formation of undesirable microstructures arising from the weld thermal cycles in the coarse grained and intercritically reheated HAZs, i.e., HAZs heated to a temperature of from about the $Ac_1$ transformation temperature to about the $Ac_3$ transformation temperature. (See Glossary for definitions of $Ac_1$ and $Ac_3$ transformation temperatures.) DBTT increases significantly with increasing grain size and embrittling microstructural constituents, such as martensite-austenite (MA) islands, in the HAZ. For example, the DBTT for the HAZ in a state-of-the-art HSLA steel, X100 linepipe for oil and gas transmission, is higher than about −50° C. (−60° F.). There are significant incentives in the energy storage and transportation sectors for the development of new steels that combine the low temperature toughness properties of the above-mentioned commercial nickel-containing steels with the high strength and low cost attributes of the HSLA steels, while also providing excellent weldability and the desired thick section capability, i.e., substantially uniform microstructure and properties (e.g., strength and toughness) in thicknesses greater than about 2.5 cm (1 inch).

In non-cryogenic applications, most commercially available, state-of-the-art, low and medium carbon HSLA steels, due to their relatively low toughness at high strengths, are either designed at a fraction of their strengths or, alternatively, processed to lower strengths for attaining acceptable toughness. In engineering applications, these approaches lead to increased section thickness and therefore, higher component weights and ultimately higher costs than if the high strength potential of the HSLA steels could be fully utilized. In some critical applications, such as high performance gears, steels containing greater than about 3 wt % Ni (such as AISI 48XX, SAE 93XX, etc.) are used to maintain sufficient toughness. This approach leads to substantial cost penalties to access the superior strength of the HSLA steels. An additional problem encountered with use of standard commercial HSLA steels is hydrogen cracking in the HAZ, particularly when low heat input welding is used.

There are significant economic incentives and a definite engineering need for low cost enhancement of toughness at high and ultra-high strengths in low alloy steels. Particularly, there is a need for a reasonably priced steel that has ultra-high strength, e.g., tensile strength greater than 830 MPa (120 ksi), and excellent cryogenic temperature toughness, e.g. DBTT lower than about −73° C. (−100° F.), both in the base plate and in the HAZ, for use in commercial cryogenic temperature applications.

Consequently, the primary objects of the present invention are to improve the state-of-the-art HSLA steel technology for applicability at cryogenic temperatures in three key areas: (i) lowering of the DBTT to less than about −73° C. (−100° F.) in the base steel and in the weld HAZ, (ii) achieving tensile strength greater than 830 MPa 120 ksi), and (iii) providing superior weldability. Other objects of the present invention arc to achieve the aforementioned HSLA steels with substantially uniform through-thickness microstructures and properties in thicknesses greater than about 2.5 cm (1 inch) and to do so using current commercially available processing techniques so that use of these steels in commercial cryogenic temperature processes is economically feasible.

SUMMARY OF THE INVENTION

Consistent with the above-stated objects of the present invention, a processing methodology is provided wherein a low alloy steel slab of the desired chemistry is reheated to an appropriate temperature then hot rolled to form steel plate and rapidly cooled, at the end of hot rolling, by quenching with a suitable fluid, such as water, to a suitable Quench Stop Temperature (QST), to produce a dual phase microstructure comprising, preferably, about 10 vol % to about 40 vol % of a ferrite phase and about 60 vol % to about 90 vol % of a second phase of predominantly fine-grained lath martensite, fine-grained lower bainite, or mixtures thereof. As used in describing the present invention, quenching refers to accelerated cooling by any means whereby a fluid selected for its tendency to increase the cooling rate of the steel is utilized, as opposed to air cooling the steel to ambient temperature. In one embodiment of this invention, the steel plate is air cooled to ambient temperature after quenching is stopped.

Also, consistent with the above-stated objects of the present invention, steels processed according to the present invention are especially suitable for many cryogenic temperature applications in that the steels have the following characteristics, preferably for steel plate thicknesses of about 2.5 cm (1 inch) and greater: (i) DBTT lower than about −73° C. (−100° F.) in the base steel and in the weld HAZ, (ii) tensile strength greater than 830 MPa (120 ksi), preferably greater than about 860 MPa (125 ksi), and more preferably greater than about 900 MPa (130 ksi), (iii) superior weldability, (iv) substantially uniform through-thickness microstructure and properties, and (v) improved toughness over standard, commercially available, HSLA steels. These steels can have a tensile strength of greater than about 930 MPa (135 ksi), or greater than about 965 MPa (140 ksi), or greater than about 1000 MPa (145 ksi).

DESCRIPTION OF THE DRAWINGS

The advantages of the present invention will be better understood by referring to the following detailed description and the attached drawings in which.

Figure 1:
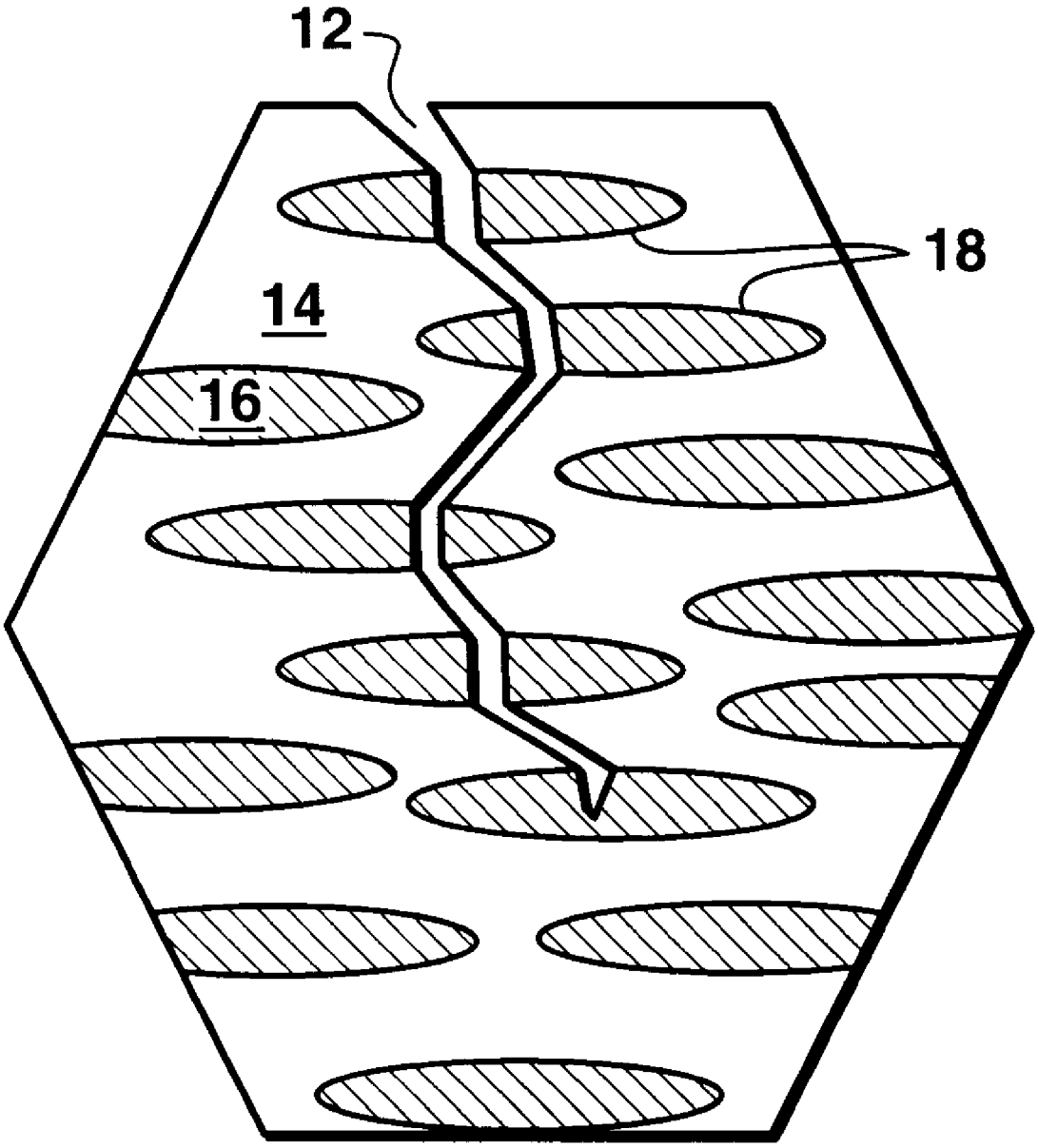
FIG. 1 is a schematic illustration of a tortuous crack path in the dual phase microcomposite structure of steels of this invention.

While the present invention will be described in connection with its preferred embodiments, it will be understood that the invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

The present invention relates to the development of new HSLA steels meeting the above-described challenges by producing an ultra-fine-grained, dual phase structure. Such dual phase microcomposite structure is preferably comprised of a soft ferrite phase and a strong second phase of predominantly fine-grained lath martensite, fine-grained lower bainite, or mixtures thereof. The invention is based on a novel combination of steel chemistry and processing for providing both intrinsic and microstructural toughening to lower DBTT as well as to enhance toughness at high strengths. Intrinsic toughening is achieved by the judicious balance of critical alloying elements in the steel as described in detail in this specification. Microstructural toughening results from achieving a very fine effective grain size as well as producing a very fine dispersion of strengthening phase while simultaneously reducing the effective grain size ("mean slip distance") in the soft phase ferrite. The second phase dispersion is optimized to substantially maximize tortuosity in the crack path, thereby enhancing the crack propagation resistance in the microcomposite steel.

In accordance with the foregoing, a method is provided for preparing an ultra-high strength, dual phase steel plate having a microstructure comprising about 10 vol % to about 40 vol % of a first phase of substantially 100 vol % ("essentially") ferrite and about 60 vol % to about 90 vol % of a second phase of predominantly fine-grained lath martensite, fine-grained lower bainite, or mixtures thereof, wherein the method comprises the steps of (a) heating a steel slab to a reheating temperature sufficiently high to (i) substantially homogenize the steel slab, (ii) dissolve substantially all carbides and carbonitrides of niobium and vanadium in the steel slab, and (iii) establish fine initial austenite grains in the steel slab; (b) reducing the steel slab to form steel plate in one or more hot rolling passes in a first temperature range in which austenite recrystallizes; (c) further reducing the steel plate in one or more hot rolling passes in a second temperature range below about the $T_{nr}$ temperature and above about the $Ar_3$ transformation temperature; (d) further reducing said steel plate in one or more hot rolling passes in a third temperature range below about the $Ar_3$ transformation temperature and above about the $Ar_1$ transformation temperature (i.e., the intercritical temperature range); (e) quenching said steel plate at a cooling rate of about 10° C. per second to about 40° C. per second (18° F./sec–72° F./sec) to a Quench Stop Temperature (QST) preferably below about the $M_s$ transformation temperature plus 200° C. (360° F.); and (f) stopping said quenching. In another embodiment of this invention, the QST is preferably below about the $M_s$ transformation temperature plus 100° C. (180° F.), and is more preferably below about 350° C. (662° F.). In one embodiment of this invention, the steel plate is allowed to air cool to ambient temperature after step (f). This processing facilitates transformation of the microstructure of the steel plate to about 10 vol % to about 40 vol % of a first phase of ferrite and about 60 vol % to about 90 vol % of a second phase of predominantly fine-grained lath martensite, fine-grained lower bainite, or mixtures thereof. (See Glossary for definitions of $T_{nr}$ temperature, and of $Ar_3$ and $Ar_1$ transformation temperatures.)

To ensure ambient and cryogenic temperature toughness, the microstructure of the second phase in steels of this invention comprises predominantly fine-grained lower bainite, fine-grained lath martensite, or mixtures thereof. It is preferable to substantially minimize the formation of embrittling constituents such as upper bainite, twinned martensite and MA in the second phase. As used in describing the present invention, and in the claims, "predominantly" means at least about 50 volume percent. The remainder of the second phase microstructure can comprise additional fine-grained lower bainite, additional fine-grained lath martensite, or ferrite. More preferably, the microstructure of the second phase comprises at least about 60 volume percent to about 80 volume percent fine-grained lower bainite, fine-grained lath martensite, or mixtures thereof Even more preferably, the microstructure of the second phase comprises at least about 90 volume percent fine-grained lower bainite, fine-grained lath martensite, or mixtures thereof.

A steel slab processed according to this invention is manufactured in a customary fashion and, in one embodiment, comprises iron and the following alloying elements, preferably in the weight ranges indicated in the following Table I:

TABLE I

| Alloying Element | Range (wt %) |
|---|---|
| carbon (C) | 0.04–0.12, more preferably 0.04–0.07 |
| manganese (Mn) | 0.5–2.5, more preferably 1.0–1.8 |
| nickel (Ni) | 1.0–3.0, more preferably 1.5–2.5 |
| niobium (Nb) | 0.02–0.1, more preferably 0.02–0.05 |
| titanium (Ti) | 0.008–0.03, more preferably 0.01–0.02 |
| aluminum (Al) | 0.001–0.05, more preferably 0.005–0.03 |
| nitrogen (N) | 0.002–0.005, more preferably 0.002–0.003 |

Chromium (Cr) is sometimes added to the steel, preferably up to about 1.0 wt % , and more preferably about 0.2 wt % to about 0.6 wt % .

Molybdenum (Mo) is sometimes added to the steel, preferably up to about 0.8 wt % , and more preferably about 0.1 wt % to about 0.3 wt %.

Silicon (Si) is sometimes added to the steel, preferably up to about 0.5 wt %, more preferably about 0.01 wt % to about 0.5 wt %, and even more preferably about 0.05 wt % to about 0.1 wt %.

Copper (Cu), preferably in the range of about 0.1 wt % to about 1.0 wt %, more preferably in the range of about 0.2 wt % to about 0.4 wt %, is sometimes added to the steel.

Boron (B) is sometimes added to the steel, preferably up to about 0.0020 wt %, and more preferably about 0.0006 wt % to about 0.0010 wt %.

The steel preferably contains at least about 1 wt % nickel. Nickel content of the steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel. If nickel content is increased above about 3 wt %, manganese content can be decreased below about 0.5 wt % down to 0.0 wt %.

Additionally, residuals are preferably substantially minimized in the steel. Phosphorous (P) content is preferably less than about 0.01 wt %. Sulfur (S) content is preferably less than about 0.004 wt %. Oxygen (O) content is preferably less than about 0.002 wt %.

Processing of the Steel Slab (1) Lowering of DBTT

Achieving a low DBTT, e.g., lower than about −73° C. (−100° F.), is a key challenge in the development of new HSLA steels for cryogenic temperature applications. The technical challenge is to maintain/increase the strength in the present HSLA technology while lowering the DBTT, especially in the HAZ. The present invention utilizes a combination of alloying and processing to alter both the intrinsic as well as microstructural contributions to fracture resistance in a way to produce a low alloy steel with excellent cryogenic temperature properties in the base plate and in the HAZ, as hereinafter described.

In this invention, microstructural toughening is exploited for lowering the base steel DBTT. A key component of this microstructural toughening consists of refining prior austenite grain size, modifying the grain morphology through thermo-mechanical controlled rolling processing (TMCP), and producing a dual phase dispersion within the fine grains, all aimed at enhancing the interfacial area of the high angle boundaries per unit volume in the steel plate. As is familiar to those skilled in the art, "grain" as used herein means an individual crystal in a polycrystalline material, and "grain boundary" as used herein means a narrow zone in a metal corresponding to the transition from one crystallographic orientation to another, thus separating one grain from another. As used herein, a "high angle grain boundary" is a grain boundary that separates two adjacent grains whose crystallographic orientations differ by more than about 8°. Also, as used herein, a "high angle boundary or interface" is a boundary or interface that effectively behaves as a high angle grain boundary, i.e., tends to deflect a propagating crack or fracture and, thus, induces tortuosity in a fracture path.

The contribution from TMCP to the total interfacial area of the high angle boundaries per unit volume, Sv, is defined by the following equation:

$$Sv = \frac{1}{d}\left(1 + R + \frac{1}{R}\right) + 0.63(r - 30)$$

where:

d is the average austenite grain size in a hot-rolled steel plate prior to rolling in the temperature range in which austenite does not recrystallize (prior austenite grain size);

R is the reduction ratio (original steel slab thickness/final steel plate thickness); and r is the percent reduction in thickness of the steel due to hot rolling in the temperature range in which austenite does not recrystallize.

Figure 2A:
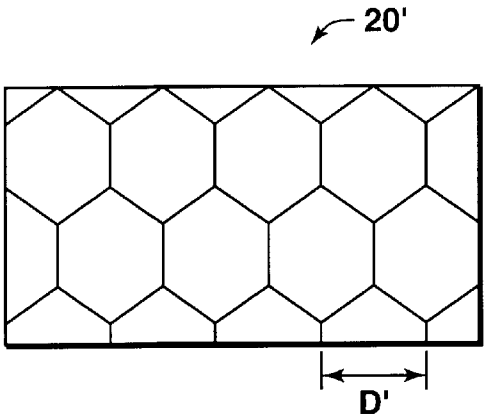
FIG. 2A is a schematic illustration of austenite grain size in a steel slab after reheating according to the present invention.
Figure 2B:
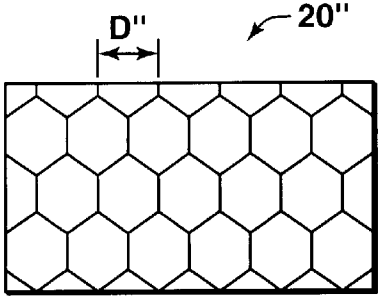
FIG. 2B is a schematic illustration of prior austenite grain size (see Glossary) in a steel slab after hot rolling in the temperature range in which austenite recrystallizes, but prior to hot rolling in the temperature range in which austenite does not recrystallize, according to the present invention.
Figure 2C:
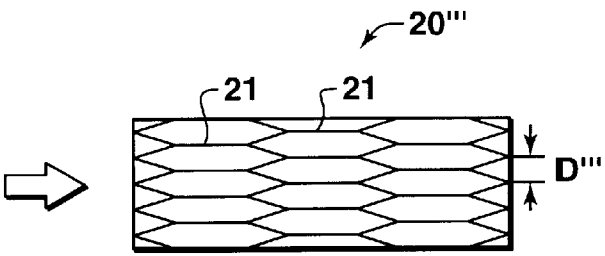
FIG. 2C is a schematic illustration of the elongated, pancake grain structure in austenite, with very fine effective grain size in the through-thickness direction, of a steel plate upon completion of TMCP according to the present invention.

It is well known in the art that as the Sv of a steel increases, the DBTT decreases, due to crack deflection and the attendant tortuosity in the fracture path at the high angle boundaries. In commercial TMCP practice, the value of R is fixed for a given plate thickness and the upper limit for the value of r is typically 75. Given fixed values for R and r, Sv can only be substantially increased by decreasing d, as evident from the above equation. To decrease d in steels according to the present invention, Ti—Nb microalloying is used in combination with optimized TMCP practice. For the same total amount of reduction during hot rolling/deformation, a steel with an initially finer average austenite grain size will result in a finer finished average austenite grain size. Therefore, in this invention the amount of Ti—Nb additions are optimized for low reheating practice while producing the desired austenite grain growth inhibition during TMCP. Referring to FIG. 2A, a relatively low reheating temperature, preferably between about 955° C. and about 1065° C. (1750° F.–1950° F.), is used to obtain initially an average austenite grain size D' of less than about 120 microns in reheated steel slab 20' before hot deformation. Processing according to this invention avoids the excessive austenite grain growth that results from the use of higher reheating temperatures, i.e., greater than about 1095° C. (2000° F.), in conventional TMCP. To promote dynamic recrystallization induced grain refining, heavy per pass reductions greater than about 10% are employed during hot rolling in the temperature range in which austenite recrystallizes. Referring now to FIG. 2B, processing according to this invention provides an average prior austenite grain size D" (i.e., d) of less than about 30 microns, preferably less than about 20 microns, and even more preferably less than about 10 microns, in steel slab 20" after hot rolling (deformation) in the temperature range in which austenite recrystallizes, but prior to hot rolling in the temperature range in which austenite does not recrystallize. Additionally, to produce an effective grain size reduction in the through-thickness direction, heavy reductions, preferably exceeding about 70% cumulative, are carried out in the temperature range below about the $T_{nr}$ temperature but above about the $Ar_3$ transformation temperature. Referring now to FIG. 2C, TMCP according to this invention leads to the formation of an elongated, pancake structure in austenite in a finish rolled steel plate 20"' with very fine effective grain size D"' in the through-thickness direction, e.g., effective grain size D"' less than about 10 microns, preferably less than about 8 microns, and even more preferably less than about 5 microns, thus enhancing the interfacial area of the high angle boundaries, e.g., 21, per unit volume in steel plate 20"', as will be understood by those skilled in the art. Finish rolling in the intercritical temperature range also induces "pancaking" in the ferrite that forms from the austenite decomposition during the intercritical exposure, which in turn leads to lowering of its effective grain size ("mean slip distance") in the through-thickness direction. The ferrite that forms from the austenite decomposition during the intercritical exposure also has a high degree of deformation substructure, including a high dislocation density (e.g., about $10^8$ or more dislocations/$cm^2$), to boost its strength. The steels of this invention are designed to benefit from the refined ferrite for simultaneous enhancement of strength and toughness.

In somewhat greater detail, a steel according to this invention is prepared by forming a slab of the desired composition as described herein; heating the slab to a temperature of from about 955° C. to about 1065° C. (1750° F.–1950° F.); hot rolling the slab to form steel plate in one or more passes providing about 30 percent to about 70 percent reduction in a first temperature range in which austenite recrystallizes, i.e., above about the $T_{nr}$ temperature, further hot rolling the steel plate in one or more passes providing about 40 percent to about 80 percent reduction in a second temperature range below about the $T_{nr}$ temperature and above about the $Ar_3$ transformation temperature, and finish rolling the steel plate in one or more passes to provide about 15 percent to about 50 percent reduction in the intercritical temperature range below about the $Ar_3$ transformation temperature and above about the $Ar_1$ transformation temperature. The hot rolled steel plate is then quenched at a cooling rate of about 10° C. per second to about 40° C. per second (18° F./sec–72° F./sec) to a suitable Quench Stop Temperature (QST) preferably below about the $M_s$ transformation temperature plus 200° C. (360° F.), at which time the quenching is terminated. In another embodiment of this invention, the QST is preferably below about the $M_s$ transformation temperature plus 100° C. (180° F.), and is more preferably below about 350° C. (662° F.). In one embodiment of this invention, the steel plate is allowed to air cool to ambient temperature after quenching is terminated.

As is understood by those skilled in the art, as used herein "percent reduction" in thickness refers to percent reduction in the thickness of the steel slab or plate prior to the reduction referenced. For purposes of explanation only, without thereby limiting this invention, a steel slab of about 25.4 cm (10 inches) thickness may be reduced about 30% (a 30 percent reduction), in a first temperature range, to a thickness of about 17.8 cm (7 inches) then reduced about 80% (an 80 percent reduction), in a second temperature range, to a thickness of about 3.6 cm (1.4 inch), and then reduced about 30% (a 30 percent reduction), in a third temperature range, to a thickness of about 2.5 cm (1 inch). As used herein, "slab" means a piece of steel having any dimensions.

The steel slab is preferably heated by a suitable means for raising the temperature of substantially the entire slab, preferably the entire slab, to the desired reheating temperature, e.g., by placing the slab in a furnace for a period of time. The specific reheating temperature that should be used for any steel composition within the range of the present invention may be readily determined by a person skilled in the art, either by experiment or by calculation using suitable models. Additionally, the furnace temperature and reheating time necessary to raise the temperature of substantially the entire slab, preferably the entire slab, to the desired reheating temperature may be readily determined by a person skilled in the art by reference to standard industry publications.

Except for the reheating temperature, which applies to substantially the entire slab, subsequent temperatures referenced in describing the processing method of this invention are temperatures measured at the surface of the steel. The surface temperature of steel can be measured by use of an optical pyrometer, for example, or by any other device suitable for measuring the surface temperature of steel. The cooling rates referred to herein are those at the center, or substantially at the center, of the plate thickness; and the Quench Stop Temperature (QST) is the highest, or substantially the highest, temperature reached at the surface of the plate, after quenching is stopped, because of heat transmitted from the mid-thickness of the plate. For example, during processing of experimental heats of a steel composition according to this invention, a thermocouple is placed at the center, or substantially at the center, of the steel plate thickness for center temperature measurement, while the surface temperature is measured by use of an optical pyrometer. A correlation between center temperature and surface temperature is developed for use during subsequent processing of the same, or substantially the sane, steel composition, such that center temperature may be determined via direct measurement of surface temperature. Also, the required temperature and flow rate of the quenching fluid to accomplish the desired accelerated cooling rate may be determined by one skilled in the art by reference to standard industry publications.

For any steel composition within the range of the present invention, the temperature that defines the boundary between the recrystallization range and non-recrystallization range, the $T_{nr}$ temperature, depends on the chemistry of the steel, particularly the carbon concentration and the niobium concentration, on the reheating temperature before rolling, and on the amount of reduction given in the rolling passes. Persons skilled in the art may determine this temperature for a particular steel according to this invention either by experiment or by model calculation. Similarly, the $Ar_1$, $Ar_3$, and $M_s$ transformation temperatures referenced herein may be determined by persons skilled in the art for any steel according to this invention either by experiment or by model calculation.

The TMCP practice thus described leads to a high value of Sv. Additionally, the dual phase microstructure produced during rapid cooling further increases the interfacial area by providing numerous high angle interfaces and boundaries, i.e., ferrite phase/second phase interfaces and martensite/lower bainite packet boundaries, as further discussed below. The heavy texture resulting from the intensified rolling in the intercritical temperature range establishes a sandwich or laminate structure in the through-thickness direction consisting of alternating sheets of soft phase ferrite and strong second phase. This configuration, as schematically illustrated in FIG. 1, leads to significant tortuosity in the through-thickness direction of the path of crack 12. This is because a crack 12 that is initiated in the soft phase ferrite 14, for instance, changes planes, i.e., changes directions, at the high angle interface 18, between the ferrite phase 14 and the second phase 16, due to the different orientation of cleavage and slip planes in these two phases. The interface 18 has excellent interfacial bond strength and this forces crack 12 deflection rather than interfacial debonding. Additionally, once the crack 12 enters the second phase 16, the crack 12 propagation is further hampered as described in the following. The lath martensite/lower bainite in the second phase 16 occur as packets with high angle boundaries between the packets. Several packets are formed within a pancake. This provides a further degree of structural refinement leading to enhanced tortuosity for crack 12 propagation through the second phase 16 within the pancake. The net result is that the crack 12 propagation resistance is significantly enhanced in the dual phase structure of steels of the present invention from a combination of factors including: the laminate texture, the break up of crack plane at the interphase interfaces, and crack deflection within the second phase. This leads to substantial increase in Sv and consequently leads to lowering of DBTT.

Although the microstructural approaches described above are useful for lowering DBTT in the base steel plate, they are not fully effective for maintaining sufficiently low DBTT in the coarse grained regions of the weld HAZ. Thus, the present invention provides a method for maintaining sufficiently low DBTT in the coarse grained regions of the weld HAZ by utilizing intrinsic effects of alloying elements, as described in the following.

Leading ferritic cryogenic temperature steels are based on body-centered cubic (BCC) crystal lattice. While this crystal system offers the potential for providing high strengths at low cost, it suffers from a steep transition from ductile to brittle fracture behavior as the temperature is lowered. This can be fundamentally attributed to the strong sensitivity of the critical resolved shear stress (CRSS) (defined herein) to temperature in BCC systems, wherein CRSS rises steeply with a decrease in temperature thereby making the shear processes and consequently ductile fracture more difficult. On the other hand, the critical stress for brittle fracture processes such as cleavage is less sensitive to temperature. Therefore, as the temperature is lowered, cleavage becomes the favored fracture mode, leading to the onset of low energy brittle fracture. The CRSS is an intrinsic property of the steel and is sensitive to the ease with which dislocations can cross slip upon deformation; that is, a steel in which cross slip is easier will also have a low CRSS and hence a low DBTT. Some face-centered cubic (FCC) stabilizers such as Ni are known to promote cross slip, whereas BCC stabilizing alloying elements such as Si, Al, Mo, Nb and V discourage cross slip. In the present invention, content of FCC stabilizing alloying elements, such as Ni, is preferably optimized, taking into account cost considerations and the beneficial effect for lowering DBTT, with Ni alloying of preferably at least about 1.0 wt % and more preferably at least about 1.5 wt %; and the content of BCC stabilizing alloying elements in the steel is substantially minimized.

As a result of the intrinsic and microstructural toughening that results from the unique combination of chemistry and processing for steels according to this invention, the steels have excellent cryogenic temperature toughness in both the base plate and the HAZ after welding. DBTTs in both the base plate and the HAZ after welding of these steels are lower than about −73° C. (−100° F.) and can be lower than about −107° C. (−160° F.).

(2) Tensile Strength greater than 830 MPa (120 ksi) and Through-Thickness Uniformity of Microstructure and Properties The strength of dual phase microcomposite structures is determined by the volume fraction and strength of the constituent phases. The second phase (martensite/lower bainite) strength is primarily dependent on its carbon content. In the present invention, a deliberate effort is made to obtain the desired strength by primarily controlling the volume fraction of second phase so that the strength is obtained at a relatively low carbon content with the attendant advantages in weldability and excellent toughness in both the base steel and in the HAZ. To obtain tensile strengths of greater than 830 MPa (120 ksi) and higher, volume fraction of the second phase is preferably in the range of about 60 vol % to about 90 vol %. This is achieved by selecting the appropriate finish rolling temperature for the intercritical rolling. A minimum of about 0.04 wt % C is preferred in the overall alloy for attaining tensile strength of at least about 1000 MPa (145 ksi).

While alloying elements, other than C, in steels according to this invention are substantially inconsequential as regards the maximum attainable strength in the steel, these elements are desirable to provide the required through-thickness uniformity of microstructure and strength for plate thickness greater than about 2.5 cm (1 inch) and for a range of cooling rates desired for processing flexibility. This is important as the actual cooling rate at the mid section of a thick plate is lower than that at the surface. The microstructure of the surface and center can thus be quite different unless the steel is designed to eliminate its sensitivity to the difference in cooling rate between the surface and the center of the plate. In this regard, Mn and Mo alloying additions, and especially the combined additions of Mo and B, are particularly effective. In the present invention, these additions are optimized for hardenability, weldability, low DBTT and cost considerations. As stated previously in this specification, from the point of view of lowering DBTT, it is essential that the total BCC alloying additions be kept to a minimum. The preferred chemistry targets and ranges are set to meet these and the other requirements of this invention.

(3) Superior Weldability For Low Heat Input Welding

The steels of this invention are designed for superior weldability. The most important concern, especially with low heat input welding, is cold cracking or hydrogen cracking in the coarse grained HAZ. It has been found that for steels of the present invention, cold cracking susceptibility is critically affected by the carbon content and the type of HAZ microstructure, not by the hardness and carbon equivalent, which have been considered to be the critical parameters in the art. In order to avoid cold cracking when the steel is to be welded under no or low preheat (lower than about 100° C. (212° F.)) welding conditions, the preferred upper limit for carbon addition is about 0.1 wt %. As used herein, without limiting this invention in any aspect, "low heat input welding" means welding with arc energies of up to about 2.5 kilojoules per millimeter (kJ/mm) (7.6 kJ/inch).

Lower bainite or auto-tempered lath martensite microstructures offer superior resistance to cold cracking. Other alloying elements in the steels of this invention are carefully balanced, commensurate with the hardenability and strength requirements, to ensure the formation of these desirable microstructures in the coarse grained HAZ.

Role of Alloying Elements in the Steel Slab

The role of the various alloying elements and the preferred limits on their concentrations for the present invention are given below:

Carbon (C) is one of the most effective strengthening elements in steel. It also combines with the strong carbide formers in the steel such as Ti, Nb, and V to provide grain growth inhibition and precipitation strengthening. Carbon also enhances hardenability, i.e., the ability to form harder and stronger microstructures in the steel during cooling. If the carbon content is less than about 0.04 wt %, it is generally not sufficient to induce the desired strengthening, viz., greater than 830 MPa (120 ksi) tensile strength, in the steel. If the carbon content is greater than about 0.12 wt %, generally the steel is susceptible to cold cracking during welding and the toughness is reduced in the steel plate and its HAZ on welding. Carbon content in the range of about 0.04 wt % to about 0.12 wt % is preferred to produce the desired HAZ microstructures, viz., auto-tempered lath martensite and lower bainite. Even more preferably, the upper limit for carbon content is about 0.07 wt %.

Manganese (Mn) is a matrix strengthener in steels and also contributes strongly to the hardenability. A minimum amount of 0.5 wt % Mn is preferred for achieving the desired high strength in plate thickness exceeding about 2.5 cm (1 inch), and a minimum of at least about 1.0 wt % Mn is even more preferred. However, too much Mn can be harmful to toughness, so an upper limit of about 2.5 wt % Mn is preferred in the present invention. This upper limit is also preferred to substantially minimize centerline segregation that tends to occur in high Mn and continuously cast steels and the attendant through-thickness non-uniformity in microstructure and properties. More preferably, the upper limit for Mn content is about 1.8 wt %. If nickel content is increased above about 3 wt %, the desired high strength can be achieved without the addition of manganese. Therefore, in a broad sense, up to about 2.5 wt % manganese is preferred.

Silicon (Si) is added to steel for deoxidation purposes and a minimum of about 0.01 wt % is preferred for this purpose. However, Si is a strong BCC stabilizer and thus raises DBTT and also has an adverse effect on the toughness. For these reasons, when Si is added, an upper limit of about 0.5 wt % Si is preferred. More preferably, the upper limit for Si content is about 0.1 wt %. Silicon is not always necessary for deoxidation since aluminum or titanium can perform the same function.

Niobium (Nb) is added to promote grain refinement of the rolled microstructure of the steel, which improves both the strength and toughness. Niobium carbide precipitation during hot rolling serves to retard recrystallization and to inhibit grain growth, thereby providing a means of austenite grain refinement. For these reasons, at least about 0.02 wt % Nb is preferred. However, Nb is a strong BCC stabilizer and thus raises DBTT. Too much Nb can be harmful to the weldability and HAZ toughness, so a maximum of about 0.1 wt % is preferred. More preferably, the upper limit for Nb content is about 0.05 wt %.

Titanium (Ti), when added in a small amount, is effective in forming fine titanium nitride (TiN) particles which refine the grain size in both the rolled structure and the HAZ of the steel. Thus, the toughness of the steel is improved. Ti is added in such an amount that the weight ratio of Ti/N is preferably about 3.4. Ti is a strong BCC stabilizer and thus raises DBTT. Excessive Ti tends to deteriorate the toughness of the steel by forming coarser TiN or titanium carbide (TiC) particles. A Ti content below about 0.008 wt % generally can not provide sufficiently fine grain size or tie up the N in the steel as TiN while more than about 0.03 wt % can cause deterioration in toughness. More preferably, the steel contains at least about 0.01 wt % Ti and no more than about 0.02 wt % Ti.

Aluminum (Al) is added to the steels of this invention for the purpose of deoxidation. At least about 0.002 wt % Al is preferred for this purpose, and at least about 0.01 wt % Al is even more preferred. Al ties up nitrogen dissolved in the HAZ. However, Al is a strong BCC stabilizer and thus raises DBTT. If the Al content is too high, i.e., above about 0.05 wt %, there is a tendency to form aluminum oxide ($Al_2O_3$) type inclusions, which tend to be harmful to the toughness of the steel and its HAZ. Even more preferably, the upper limit for Al content is about 0.03 wt %.

Molybdenum (Mo) increases the hardenability of steel on direct quenching, especially in combination with boron and niobium. However, Mo is a strong BCC stabilizer and thus raises DBTT. Excessive Mo helps to cause cold cracking on welding, and also tends to deteriorate the toughness of the steel and HAZ, so when Mo is added, a maximum of about 0.8 wt % is preferred. More preferably, when Mo is added, the steel contains at least about 0.1 wt % Mo and no more than about 0.3 wt % Mo.

Chromium (Cr) tends to increase the hardenability of steel on direct quenching. Cr also improves corrosion resistance and hydrogen induced cracking (HIC) resistance. Similar to Mo, excessive Cr tends to cause cold cracking in weldments, and tends to deteriorate the toughness of the steel and its HAZ, so when Cr is added, a maximum of about 1.0 wt % Cr is preferred. More preferably, when Cr is added, the Cr content is about 0.2 wt % to about 0.6 wt %.

Nickel (Ni) is an important alloying addition to the steels of the present invention to obtain the desired DBTT, especially in the HAZ. It is one of the strongest FCC stabilizers in steel. Ni addition to the steel enhances the cross slip and thereby lowers DBTT. Although not to the same degree as Mn and Mo additions, Ni addition to the steel also promotes hardenability and therefore through-thickness uniformity in microstructure and properties in thick sections (i.e., thicker than about 2.5 cm (1 inch)). For achieving the desired DBTT in the weld HAZ, the minimum Ni content is preferably about 1.0 wt %, more preferably about 1.5 wt %. Since Ni is an expensive alloying element, the Ni content of the steel is preferably less than about 3.0 wt %, more preferably less than about 2.5 wt %, more preferably less than about 2.0 wt %, and even more preferably less than about 1.8 wt %, to substantially minimize cost of the steel.

Copper (Cu) is an FCC stabilizer in steel and can contribute to lowering of DBTT in small amounts. Cu is also beneficial for corrosion and HIC resistance. At higher amounts, Cu induces excessive precipitation hardening via ε-copper precipitates. This precipitation, if not properly controlled, can lower the toughness and raise the DBTT both in the base plate and HAZ. Higher Cu can also cause embrittlement during slab casting and hot rolling, requiring co-additions of Ni for mitigation. For the above reasons, when copper is added to the steels of this invention, an upper limit of about 1.0 wt % Cu is preferred, and an upper limit of about 0.4 wt % Cu is even more preferred.

Boron (B) in small quantities can greatly increase the hardenability of steel and promote the formation of steel microstructures of lath martensite, lower bainite, and ferrite by suppressing the formation of upper bainite, both in the base plate and the coarse grained HAZ. Generally, at least about 0.0004 wt % B is needed for this purpose. When boron is added to steels of this invention, from about 0.0006 wt % to about 0.0020 wt % is preferred, and an upper limit of about 0.0010 wt % is even more preferred. However, boron may not be a required addition if other alloying in the steel provides adequate hardenability and the desired microstructure.

(4) Preferred Steel Composition When Post Weld Heat Treatment (PWHT) Is Required PWHT is normally carried out at high temperatures, e.g., greater than about 540° C. (1000° F.). The thennal exposure from PWHT can lead to a loss of strength in the base plate as well as in the weld HAZ due to softening of the microstructure associated with the recovery of substructure (i.e., loss of processing benefits) and coarsening of cementite particles. To overcome this, the base steel chemistry as described above is preferably modified by adding a small amount of vanadium. Vanadium is added to give precipitation strengthening by forming fine vanadium carbide (VC) particles in the base steel and HAZ upon PWHT. This strengthening is designed to offset substantially the strength loss upon PWHT. However, excessive VC strengthening is to be avoided as it can degrade the toughness and raise DBTT both in the base plate and its HAZ. In the present invention an upper limit of about 0.1 wt % is preferred for V for these reasons. The lower limit is preferably about 0.02 wt %. More preferably, about 0.03 wt % to about 0.05 wt % V is added to the steel.

This step-out combination of properties in the steels of the present invention provides a low cost enabling technology for certain cryogenic temperature operations, for example, storage and transport of natural gas at low temperatures. These new steels can provide significant material cost savings for cryogenic temperature applications over the current state-of-the-art commercial steels, which generally require far higher nickel contents (up to about 9 wt %) and are of much lower strengths (less than about 830 MPa (120 ksi)). Chemistry and microstructure design are used to lower DBTT and provide uniform mechanical properties in the through-thickness for section thicknesses exceeding about 2.5 cm. (1 inch). These new steels preferably have nickel contents lower than about 3 wt %, tensile strength greater than 830 MPa (120 ksi), preferably greater than about 860 MPa (125 ksi), and more preferably greater than about 900 MPa (130 ksi), ductile to brittle transition temperatures (DBTTs) below about −73° C. (−100° F.), and offer excellent toughness at DBTT. These new steels can have a tensile strength of greater than about 930 MPa (135 ksi), or greater than about 965 MPa (140 ksi), or greater than about 1000 MPa (145 ksi). Nickel content of these steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel.

While the foregoing invention has been described in terms of one or more preferred embodiments, it should be understood that other modifications may be made without departing from the scope of the invention, which is set forth in the following claims.

| Glossary of terms: | |
|---|---|
| $AC_1$ transformation temperature: | the temperature at which austenite begins to form during heating; |
| $Ac_3$ transformation temperature: | the temperature at which transformation of ferrite to austenite is completed during heating; |
| $Al_2O_3$: | aluminum oxide; |
| $Ar_1$ transformation temperature: | the temperature at which transformation of austenite to ferrite or to ferrite plus cementite is completed during cooling; |
| $Ar_3$ transformation temperature: | the temperature at which austenite begins to transform to ferrite during cooling; |
| BCC: | body-centered cubic; |
| cooling rate: | cooling rate at the center, or substantially at the center, of the plate thickness; |
| CRSS (critical resolved shear stress): | an intrinsic property of a steel, sensitive to the ease with which dislocations can cross slip upon deformation, that is, a steel in which cross slip is easier will also have a low CRSS and hence a low DBTT; |
| cryogenic temperature: | any temperature lower than about −40° C. (−40° F.); |
| DBTT (Ductile to Brittle Transition Temperature): | delineates the two fracture regimes in structural steels; at temperatures below the DBTT, failure tends to occur by low energy cleavage (brittle) fracture, while at temperatures above the DBTT, failure tends to occur by high energy ductile fracture; |
| essentially: | substantially 100 vol %; |
| FCC: | face-centered cubic; |

-continued

| Glossary of terms: | |
|---|---|
| grain: | an individual crystal in a polycrystalline material; |
| grain boundary: | a narrow zone in a metal corresponding to the transition from one crystallographic orientation to another, thus separating one grain from another; |
| HAZ: | heat affected zone; |
| HIC: | hydrogen induced cracking; |
| high angle boundary or interface: | boundary or interface that effectively behaves as a high angle grain boundary, i.e., tends to deflect a propagating crack or fracture and, thus, induces tortuosity in a fracture path; |
| high angle grain boundary: | a grain boundary that separates two adjacent grains whose crystallographic orientations differ by more than about 8°; |
| HSLA: | high strength, low alloy; |
| intercritically reheated: | heated (or reheated) to a temperature of from about the $Ac_1$ transformation temperature to about the $Ac_3$ transformation temperature; |
| intercritical temperature range: | from about the $Ac_1$ transformation temperature to about the $Ac_3$ transformation temperature on heating, and from about the $Ar_3$ transformation temperature to about the $Ar_1$ transformation temperature on cooling; |
| low alloy steel: | a steel containing iron and less than about 10 wt % total alloy additives; |
| low heat input welding: | welding with arc energies of up to about 2.5 kJ/mm (7.6 kJ/inch); |
| MA: | martensite-austenite; |
| mean slip distance: | effective grain size; |
| $M_S$ transformation temperature: | the temperature at which transformation of austenite to martensite starts during cooling; |
| predominantly: | as used in describing the present invention, means at least about 50 volume percent; |
| prior austenite grain size: | average austenite grain size in a hot-rolled steel plate prior to rolling in the temperature range in which austenite does not recrystallize; |
| quenching: | as used in describing the present invention, accelerated cooling by any means whereby a fluid selected for its tendency to increase the cooling rate of the steel is utilized, as opposed to air cooling; |
| Quench Stop Temperature (QST): | the highest, or substantially the highest, temperature reached at the surface of the plate, after quenching is stopped, because of heat transmitted from the mid-thickness of the plate; |
| slab: | a piece of steel having any dimensions; |
| Sv: | total interfacial area of the high angle boundaries per unit volume in steel plate; |
| tensile strength: | in tensile testing, the ratio of maximum load to original cross-sectional area; |
| TiC: | titanium carbide; |
| TiN: | titanium nitride; |
| $T_{nr}$ temperature: | the temperature below which austenite does not recrystallize; and |
| TMCP: | thermo-mechanical controlled rolling processing. |

We claim:

1. A method for preparing a dual phase steel plate having a microstructure comprising about 10 vol % to about 40 vol % of a first phase of essentially ferrite and about 60 vol % to about 90 vol % of a second phase of predominantly fine-grained lath martensite, fine-grained lower bainite, or mixtures thereof, said method comprising the steps of:

(a) heating a steel slab to a reheating temperature sufficiently high to (i) substantially homogenize said steel slab, (ii) dissolve substantially all carbides and carbonitrides of niobium and vanadium in said steel slab, and (iii) establish fine initial austenite grains in said steel slab;

(b) reducing said steel slab to form steel plate in one or more hot rolling passes in a first temperature range in which austenite recrystallizes;

(c) further reducing said steel plate in one or more hot rolling passes in a second temperature range below about the $T_{nr}$ temperature and above about the $Ar_3$ transformation temperature;

(d) further reducing said steel plate in one or more hot rolling passes in a third temperature range between about the $Ar_3$ transformation temperature and about the $Ar_1$ transformation temperature;

(e) quenching said steel plate at a cooling rate of about 10° C. per second to about 40° C. per second (18° F./sec–72° F./sec) to a Quench Stop Temperature below about the $M_s$ transformation temperature plus 200° C. (360° F.); and (f) stopping said quenching, so as to facilitate transformation of said microstructure of said steel plate to about 10 vol % to about 40 vol % of a first phase of ferrite and about 60 vol % to about 90 vol % of a second phase of predominantly fine-grained lath martensite, fine-grained lower bainite, or mixtures thereof.

2. The method of claim 1 wherein said reheating temperature of step (a) is between about 955° C. and about 1065° C. (1750° F.–1950° F.).

3. The method of claim 1 wherein said fine initial austenite grains of step (a) have a grain size of less than about 120 microns.

4. The method of claim 1 wherein a reduction in thickness of said steel slab of about 30% to about 70% occurs in step (b).

5. The method of claim 1 wherein a reduction in thickness of said steel plate of about 40% to about 80% occurs in step (c).

6. The method of claim 1 wherein a reduction in thickness of said steel plate of about 15% to about 50% occurs in step (d).

7. The method of claim 1 further comprising the step of allowing said steel plate to air cool to ambient temperature after stopping said quenching in step (f).

8. The method of claim 1 wherein said steel slab of step (a) comprises iron and the following alloying elements in the weight percents indicated:

about 0.04% to about 0. 12% C, at least about 1% Ni to less than about 9% Ni, about 0.02% to about 0.1 % Nb, about 0.008% to about 0.03% Ti, about 0.001% to about 0.05% Al, and about 0.002% to about 0.005% N.

9. The method of claim 8 wherein said steel slab comprises less than about 6 wt % Ni.

10. The method of claim 8 wherein said steel slab comprises less than about 3 wt % Ni and additionally comprises about 0.5 wt % to about 2.5 wt % Mn.

11. The method of claim 8 wherein said steel slab further comprises at least one additive selected from the group consisting of (i) up to about 1.0 wt % Cr, (ii) up to about 0.8 wt % Mo, (iii) up to about 0.5% Si, (iv) about 0.02 wt % to about 0.10 wt % V, (v) about 0.1 wt % to about 1.0 wt % Cu, and up to about 2.5 wt % Mn.

12. The method of claim 8 wherein said steel slab further comprises about 0.0004 wt % to about 0.0020 wt % B.

13. The method of claim 1 wherein, after step (f), said steel plate has a DBTT lower than about −73° C.(−100° F.) in both said base plate and its HAZ and has a tensile strength greater than 830 MPa (120 ksi).

14. The method of claim 1 wherein said first phase comprises about 10 vol % to about 40 vol % deformed ferrite.

15. A dual phase steel plate having a microstructure comprising about 10 vol % to about 40 vol % of a first phase of essentially ferrite and about 60 vol % to about 90 vol % of a second phase of predominantly fine-grained lath martensite, fine-grained lower bainite, or mixtures thereof, having a tensile strength greater than 830 MPa (120 ksi), and having a DBTT of lower than about −73° C. (−100° F.) in both said steel plate and its HAZ, and wherein said steel plate is produced from a reheated steel slab comprising iron and the following alloying elements in the weight percents indicated:

about 0.04% to about 0. 12% C, at least about 1% Ni to less than about 9% Ni, about 0.02% to about 0. 1% Nb, about 0.008% to about 0.03% Ti, about 0.001% to about 0.05% Al, and about 0.002% to about 0.005% N.

16. The steel plate of claim 15 wherein said steel slab comprises less than about 6 wt % Ni.

17. The steel plate of claim 15 wherein said steel slab comprises less than about 3 wt % Ni and additionally comprises about 0.5 wt % to about 2.5 wt % Mn.

18. The steel plate of claim 15 further comprising at least one additive selected from the group consisting of (i) up to about 1.0 wt % Cr, (ii) up to about 0.8 wt % Mo, (iii) up to about 0.5% Si, (iv) about 0.02 wt % to about 0.10 wt % V, (v) about 0.1 wt % to about 1.0 wt % Cu, and (vi) up to about 2.5 wt % Mn.

19. The steel plate of claim 15 further comprising about 0.0004 wt % to about 0.0020 wt % B.

20. The steel plate of claim 15, wherein said microstructure is optimized to substantially maximize crack path tortuosity by thermo-mechanical controlled rolling processing that provides a plurality of high angle interfaces between said first phase of essentially ferrite and said second phase of predominantly fine-grained lath martensite, fine-grained lower bainite, or mixtures thereof.

21. A method for enhancing the crack propagation resistance of a steel plate, said method comprising processing said steel plate comprising at least about 1% Ni to less than about 9% Ni to produce a microstructure comprising about 10 vol % to about 40 vol % of a first phase of essentially ferrite and about 60 vol % to about 90 vol % of a second phase of predominantly fine-grained lath martensite, fine-grained lower bainite, or mixtures thereof, said microstructure being optimized to substantially maximize crack path tortuosity by thermo-mechanical controlled rolling processing that provides a plurality of high angle interfaces between said first phase of essentially ferrite and said second phase of predominantly fine-grained lath martensite, fine-grained lower bainite, or mixtures thereof.

22. The method of claim 21 wherein said crack propagation resistance of said steel plate is further enhanced, and crack propagation resistance of the HAZ of said steel plate when welded is enhanced, by adding at least about 1.0 wt % Ni and by substantially minimizing addition of BCC stabilizing elements.

* * * * *